US005340037A

United States Patent [19]

Wallace et al.

[11] Patent Number: 5,340,037

[45] Date of Patent: Aug. 23, 1994

[54] METHOD AND APPARATUS FOR GRINDING HOT MATERIAL AND RECOVERING GASSES EMITTED THEREFROM

[75] Inventors: Paul S. Wallace, Katy; Henry C. Chan, Bellaire, both of Tex.

[73] Assignee: Texaco Inc., White Plains, N.Y.

[21] Appl. No.: 884,821

[22] Filed: May 18, 1992

[51] Int. Cl.[5] ..... F23K 1/02; B02C 15/00

[52] U.S. Cl. ..... 241/62; 241/171; 241/21; 100/222; 100/232

[58] Field of Search ..... 241/21, 62, DIG. 14, 241/171; 110/222, 232

[56] References Cited

U.S. PATENT DOCUMENTS

| | | | |
|---|---|---|---|
| 1,413,116 | 4/1922 | Hickey | 241/62 |
| 2,511,742 | 6/1950 | Shafer | 241/171 X |
| 2,628,036 | 2/1953 | Hall | 241/62 X |
| 3,013,734 | 12/1961 | Hischmann | 241/62 X |
| 3,289,950 | 12/1966 | Helming et al. | 241/62 X |
| 3,887,142 | 6/1975 | McElvain | 241/171 X |

*Primary Examiner*—Rinaldi I. Rada
*Assistant Examiner*—Clark F. Dexter
*Attorney, Agent, or Firm*—James L. Bailey; Kenneth R. Priem; Eagan Russell J.

[57] ABSTRACT

A system for grinding hot coke includes feeding the hot coke into the system, while maintaining the system under less than atmospheric pressure, wetting the coke during this feeding step to assure constant flow of the coke into a grinding mill where the coke is reduced to a slurry and forwarded to a holding tank. The system includes apparatus to recover and treat vapors derived from the grinding of the coke and to feed the slurry to gasification means.

6 Claims, 2 Drawing Sheets

METHOD AND APPARATUS FOR GRINDING HOT MATERIAL AND RECOVERING GASSES EMITTED THEREFROM

BACKGROUND OF THE INVENTION

1. The Field of the Invention

The present invention relates to a method and apparatus for grinding heated materials and recovering gasses emitted from the materials during the grinding operation and, in particular, to a method and apparatus for treating hot coke.

2. The Prior Art

There has been a long history of use of coke in the production of energy. The coke has been delivered in a heated condition and then is used as a fuel source. However, in its initial form the coke is not particularly suitable for direct use as a gasification feedstock since its size is generally too large to gasify efficiently. Thus it is necessary to grind the coke and produce a slurry of the ground coke and water which, being in a semi fluid state, can be readily pumped for distribution to a gasifier. However, grinding of coke presents a number of problems. As mentioned above, the coke is initially heated and if it is immediately milled, then coke emits a substantial quantity of gas containing large amounts of sulfur and other materials deemed hazardous to the environment. If the coke is cooled to a condition wherein the undesirable environmentally hazardous gaseous products are not generated during milling, then expensive and mechanically unreliable solids cooling equipment must be used to lower the temperature of the coke.

The present invention provides a solution to the above dilemma by proposing a method and apparatus for handling coke at its normally elevated temperature with the coke being reduced to the desired size by milling and the vapors emitted therefrom being trapped in such a manner that they can be easily recovered.

SUMMARY OF THE INVENTION

The present invention has essentially three sections, namely a coke feeding section, a milling or grinding section which produces a slurry discharge, and a vapor recovery section. The milling and slurry discharge section of the present invention operates under a slight vacuum created in the vapor recovery section with the vacuum being maintained by the conditions created by the coke feed section. The feed section includes choke means wherein restricted passage of the coke through the choke means helps to maintain the vacuum within the system. The feed section also includes means to introduce water so as to both wet the coke as well as to ensure flow and to prevent the coke from becoming packed in such a manner as to effectively prevent further movement of the coke into the milling section. The milling or grinding section includes a mill which both reduces the size of the coke and discharges it into at least one slurry tank. The slurry tanks hold sufficient volume of the coke slurry to assure uninterrupted delivery to a gasifier. The vapor recovery section acts under a slight vacuum so that substantially all of the gasses, as well as the lighter particulate material, generated by the grinding operation, will be collected in a form which is conducive to further processing without discharge into the atmosphere.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
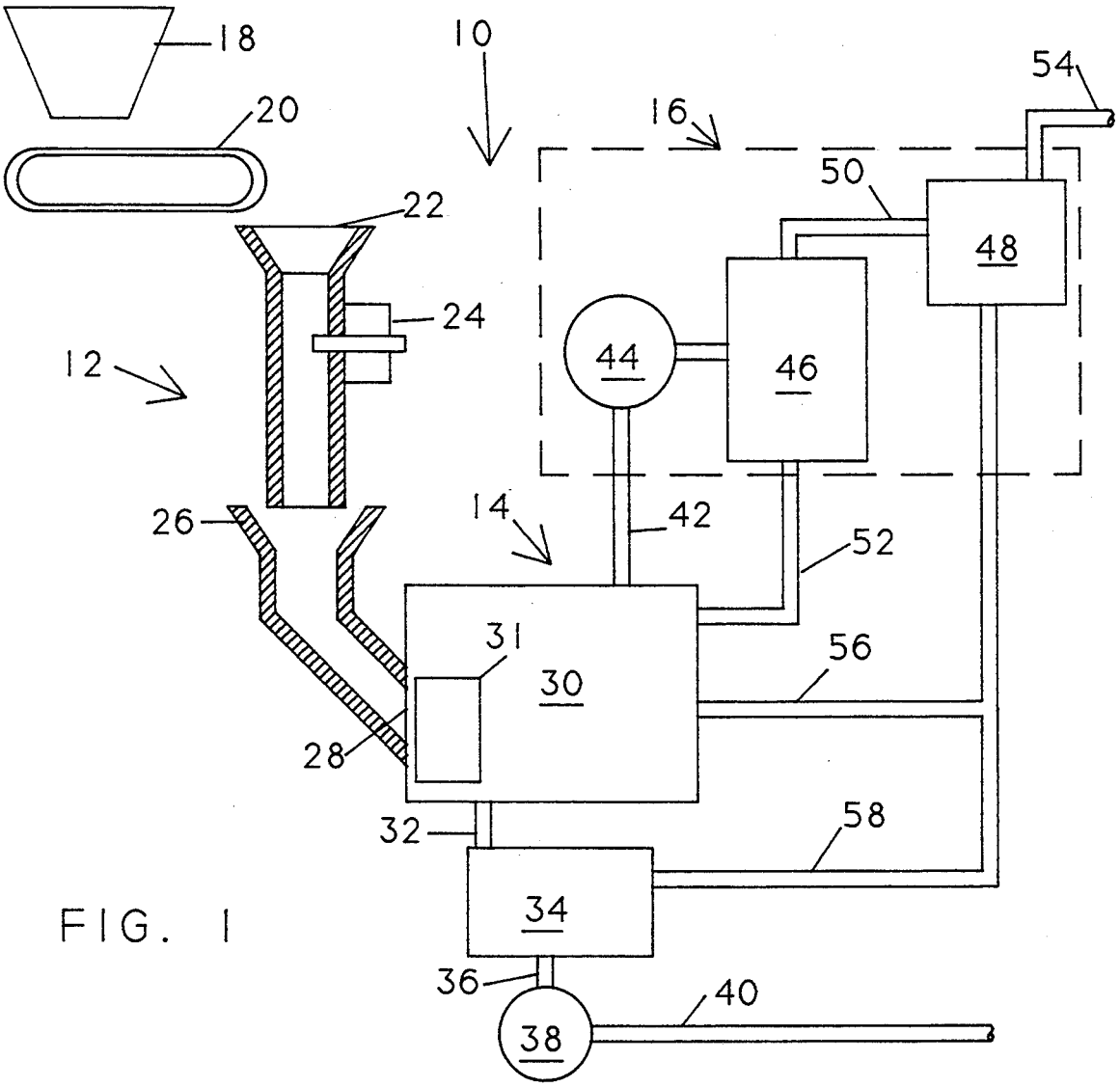
FIG. 1 is a schematic diagram of a first embodiment of the subject invention.

The subject invention 10 has three sections, namely the feed section 12, the grinding or milling section 14 and the vapor recovery section 16. The feed section 12 includes a coke receiving storage bin 18 provided with means (not shown) to prevent bridging problems and which is periodically filled with coke at approximately 400° F. The storage bin 18 is disposed above and feeds coke to a high temperature weight belt feeder 20, typically a constant weight, variable speed type feeder, which feeds the coke into a substantially vertical chute 22 at a controlled rate. The chute 22 is provided with choke means 24 therein. The chute 22 further includes water injection means 26 connected to a source of water (not shown) and which feeds water to the interior of the chute 22 in a patterned array to insure that the coke is thoroughly wetted. The chute 22 terminates at and quenches an entry port 28 of ball mill 30 where grinding occurs by known means 31. The cooled coke, heated water, and vapor enter the mill through port 28. The coke and water slurry output of the ball mill 30 is fed through discharge pipe 32 to at least one run holding tank 34, which preferably includes mixer means (not shown) to keep the coke in suspension in the slurry and has sufficient capacity to insure uninterrupted supply of slurry feed to gasifier means (not shown). The slurry is fed through pipe 36 to a discharge pump 38 which pumps the slurry through pipe 40 to the gasifier. The ball mill 30 is also connected by pipe 42 to condenser means 44 and vapor recovery means 46. A vacuum source 48 is connected by pipe 50 to the vapor recovery unit 46 which in turn is connected to mill 30 by pipe 52. Vapors recovered by the vacuum means 48 can be forwarded by pipe 54 to a Claus unit or other like known unit (not shown) for disposal.

Unique features of the feed section of the present invention include the choke means 24 and the water injecting means 26. In the first embodiment, FIG. 1, the choke means 24 has been shown as a slide valve which forms an adjustable restriction in the sealed feed chute 22 leading to the mill 30. The slide valve prevents excessive amounts of air from being sucked into the mill which, as previously stated, operates under a slight vacuum. The water injecting means 26 is preferably a segmented ring, or other similar means, which will provide a film of water around the entire periphery of the chute 22. Since most of the hot coke lands on the bottom third of the chute 22 at the entry port, there is a potential for line plugging at this point. However, a split quenching ring design allows water injection to be adjusted to provide a heavier flow of water on the bottom of the chute, to prevent plugging and move the coke, while compensating for the lighter solids which would tend to rise toward the top and yet still need to be wetted by a lighter flow of water.

The vapor recovery section 16 consists of condenser means 44, liquid/vapor separator and recovery means 46, and vacuum source 48. The vapor recovery section serves to receive, condense and recycle vapors discharged from the mill 30 during the grinding operation. Some of the condensed vapor can be blown through the vacuum source 48 and down through pipes 56 and 58 to mill 30 and or slurry tank 34, respectively, to eliminate any solid buildup problem. Most of the condensed vapor is recycled to the mill through pipe 52 from the liquid vapor separator 46.

One unique feature of the vapor recovery section 16 is that it produces substantially no emissions to the environment since the entire grinding system is substantially sealed to operate under a slight vacuum so that only a small amount of air, from leakage and voids within the coke, remains in the vapor phase. This small amount of air can be sent to a standard Claus unit reactor (not shown) where the trace amounts of hydrogen sulfide and carbon monoxide it carries can be destroyed.

Another unique feature of the present invention is the equalization of pressure between the mill 30 and the run holding tank 34. Since there is only gravity flow between the mill and the tank, if the tank were to be operating at atmospheric pressure while the mill is under slight vacuum, then this pressure differential would tend to push against the gravity flow of slurry from the mill to the tank thereby causing problems. Pressure equalization between the mill and tank prevents slurry flow problems.

The coke is wet ground in mill 30 to a specific particle-size and sufficient water added until a controlled solids concentration is reached. The resulting slurry is stored in tank 34, whose capacity insures an uninterrupted supply of slurry feed to gasification means (not shown).

For recycling operations, a tank (not shown) equipped with an agitator and pumps is required to collect any unconverted char from the gasification plant, which material will be mixed with the feed streams to the ball mill 30.

Figure 2:
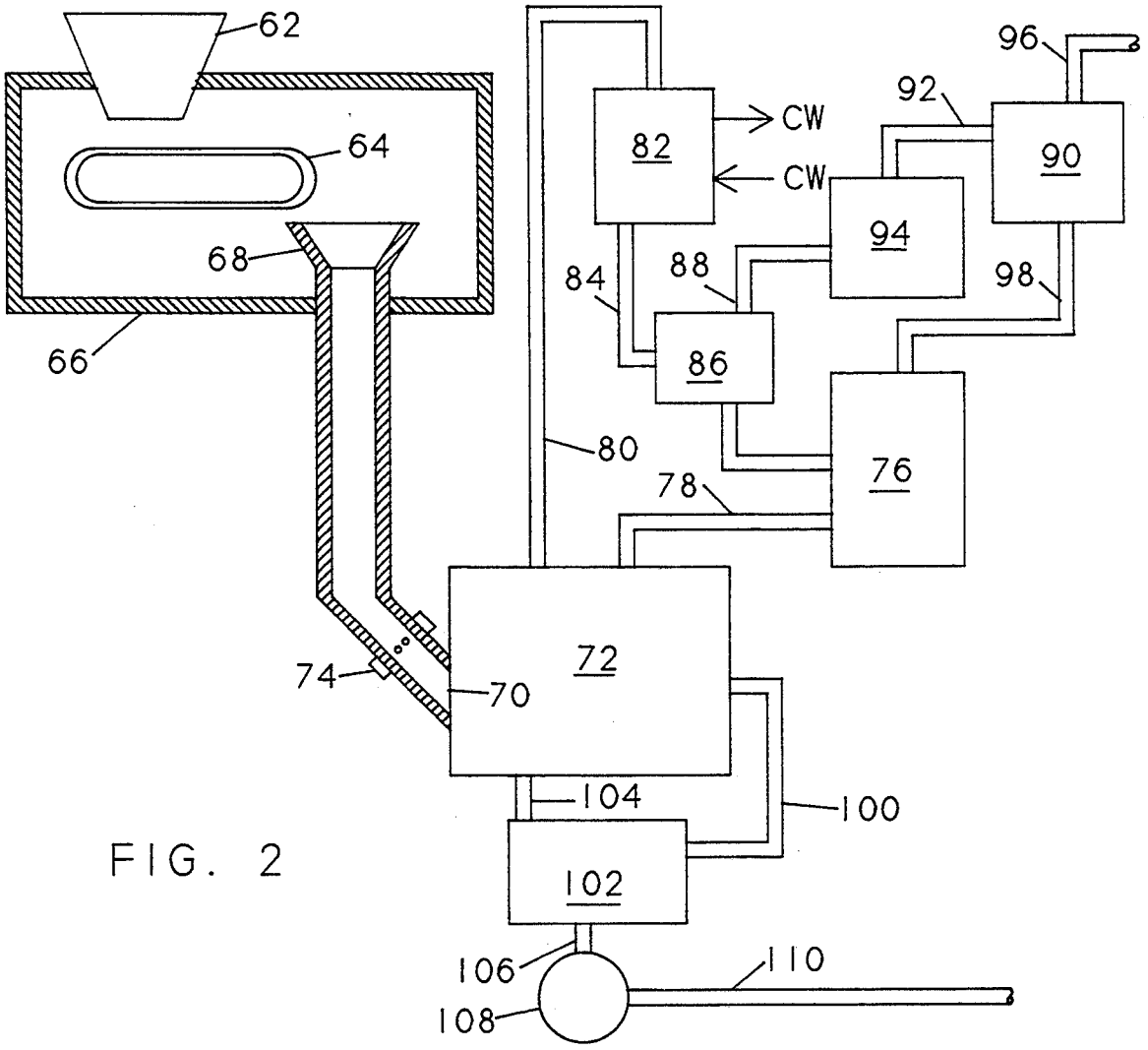
FIG. 2 is a schematic diagram of an alternate embodiment of the present invention.

An alternate embodiment of the present invention is shown in FIG. 2. In this embodiment the coke is delivered from a storage bin 62 to discharge onto a coke-weight belt feeder 64, both of which are similar to like components of the preferred embodiment. The bin 62 is provided with means (not shown) to prevent bridging by the coke and thereby maintain flow of coke through the bin. Bridging can be prevented by any one of many well known devices for stirring, agitating or vibrating the coke. In this alternate embodiment of the present invention, the hopper 62 feeds into a vacuum chamber 66 which encloses the belt feeder 64 and the upper end of the feed chute 68. In this embodiment the hopper itself acts somewhat as the choke of the previous embodiment to prevent excessive amounts of air from being drawn into the system.

Coke (again at approximately 400° F.) is fed by the constant weight-variable speed belt feeder 64 to provide a controlled rate of feed of coke through the chute 68 to the entrance port 70 of the ball mill 72. In this embodiment one or more nozzle arrays 74 are located in the vicinity of the lower end of the feed chute 68 and the entrance port 70 to the ball mill 72 and serve for a similar purpose as the quench ring of the previous embodiment, namely to add sufficient water flow to prevent load up of the coke and therefore stoppage of feed into the mill. Slurry makeup water from nozzle arrays 74 is mixed with the coke from the chute 68. The quantity of makeup water is regulated on the basis of the total flow requirements since a large quantity of water accompanies recycled solids, as discussed below.

A caustic source (not shown) can be included in the system to pump a caustic solution to the ball mill to assure proper pH control.

Unconverted solids, consisting of char and ash, are collected in a recycle tank 76 and the material is mixed with makeup water and recycled to the ball mill 72 through pipe 78. The ball mill 72 is equipped with a vapor recovery system since the coke from the fluid coke will be hot (400° F.) when it is ground. The hot coke will generate steam in the mill, along with trace amounts of sulfur compounds which could cause emission problems if directly discharged into the atmosphere. The mill vapor flows through pipe 80 and down through a vertical condenser 82 and into vapor fluid separator 86 via pipe 84. The condenser 82 uses clean tempered cooling water CW flowing from a source (not shown). The condensate is knocked out in a first vapor-fluid separator 86 and is returned through the recycle tank 76 to mill 72. Non-condensed vapor is pulled by vacuum source 90 through pipe 88 to second vapor-fluid separator 94 which uses purge water. The remaining non-condensed vapor in the overhead of vapor fluid separator 94, which is mainly air with traces of sulfur compounds, is sent to a sulfur recovery unit (not shown) through pipe 96. Any condensate collected in the second vapor fluid separator 94 is returned via pipe 98 through recycle tank 76 to the mill 72.

The mill discharge tank 102 is connected to ball mill 72 by pipes 100 and 104 and by pipe 106 to feed pump 108 which pumps the slurry to slurry storage (not shown) through pipe 110.

The non-condensed vapor, which is primarily steam with solids entrained therein, is withdrawn from the ball mill 72 through pipe 80 to a first liquid phase separator 86 and second liquid phase separator 94 by the action of vacuum source 90. The liquids are separated from the vapor and recycled while the vapors are refined sufficiently to be conveniently disposed of by known means, such as a Claus unit, without endangering the environment.

The present invention may be subject to many modifications and changes which will occur to those skilled in the art. The present embodiment should therefore be considered in all respects as illustrative and not restrictive of the scope of the invention.

We claim:

1. An apparatus for preparing hot coke for gasification comprising:

coke grinding means having a closed housing defining a grinding chamber with grinding means within said chamber, inlet port means, slurry exit means, and vapor exit port means;

constant rate, hot coke feed means connected to said inlet port means, said feed means having a top and a bottom;

means to add water to said hot coke in said feed means prior to entering said inlet port means;

vapor recovery means connected to said vapor exit port and comprising vacuum source means to maintain said grinding means under slight vacuum, so that gases with particulate matter entrained therein released during said grinding operation will be drawn off into said vapor recovery means, and liquid-vapor separator means to effect liquid/solid separation and recovery of said gases; and slurry holding means receiving slurry from said slurry exit means and feeding it as a fuel feed stock.

2. The apparatus according to claim 1 wherein said feed means further comprises:

means to assist in maintaining a partial vacuum within said system; and wherein said means to add water to said coke does so in a patterned array with more water being added to the bottom of said feed means to facilitate movement of said coke into said inlet port.

3. The apparatus according to claim 2 wherein said means to assist in maintaining a partial vacuum comprises choke valve means limiting the amount of air which is drawn into the system along with the coke.

4. The apparatus according to claim 2 wherein said means to inject water comprises:

ring means providing a heavier flow of water to the bottom of the feed means and a lighter flow to the top of the feed means whereby the coke is entirely wetted and moved along to the inlet port means.

5. The apparatus according to claim 2 wherein said means to inject water comprises an array of nozzles in said feed means providing a light flow of water to the coke at the top of the feed means to thoroughly wet it and a heavier flow of water to the bottom of the feed means to insure movement of said coke through the feed means.

6. The apparatus according to claim 1 wherein said grinding means reduces the coke to a substantially uniform size in which it is then fed through the slurry exit means to said slurry holding means wherein said slurry holding means comprises:

at least one holding tank of sufficient capacity to insure uninterrupted flow of feedstock.

* * * * *